US007887132B2

(12) United States Patent
Link

(10) Patent No.: US 7,887,132 B2
(45) Date of Patent: Feb. 15, 2011

(54) CHAIR

(75) Inventor: Werner Link, Messstetten (DE)

(73) Assignee: Interstuhl Bueromoebel GmbH & Co. KG, Messstetten (DE)

( * ) Notice: Subject to any disclaimer, the term of this patent is extended or adjusted under 35 U.S.C. 154(b) by 365 days.

(21) Appl. No.: 12/117,174

(22) Filed: May 8, 2008

(65) Prior Publication Data

US 2008/0258530 A1 Oct. 23, 2008

Related U.S. Application Data

(63) Continuation-in-part of application No. 11/047,042, filed on Jan. 31, 2005, now abandoned.

(30) Foreign Application Priority Data

Feb. 13, 2004 (DE) ..... 10 2004 007 093

(51) Int. Cl.
*A47C 1/032* (2006.01)

(52) U.S. Cl. ..... 297/327; 297/323; 297/328; 297/354.12

(58) Field of Classification Search ..... 297/316, 297/325, 327, 354.1, 354.12, 326, 323, 328
See application file for complete search history.

(56) References Cited

U.S. PATENT DOCUMENTS

| | | | | |
|---|---|---|---|---|
| 2,638,968 | A * | 5/1953 | Joncas | 297/326 |
| 3,361,472 | A | 1/1968 | Hasbrouck | |
| 3,883,174 | A * | 5/1975 | Roscoe | 297/354.12 |
| 4,682,814 | A | 7/1987 | Hansen | |
| 5,460,427 | A * | 10/1995 | Serber | 297/316 |
| 5,613,735 | A | 3/1997 | Goiset | |
| 5,658,045 | A | 8/1997 | Van Koolwijk et al. | |
| 6,644,741 | B2 | 11/2003 | Nelson et al. | |
| 7,073,860 | B2 | 7/2006 | Markus | |
| 2003/0184140 | A1 | 10/2003 | Bruske | |

FOREIGN PATENT DOCUMENTS

| | | |
|---|---|---|
| DE | 76 29 160 | 2/1977 |
| DE | 30 33 953 | 5/1981 |
| DE | 44 03 123 | 8/1995 |
| DE | 196 07 136 | 8/1996 |
| DE | 297 04 906 | 5/1997 |
| WO | 94/10001 | 5/1994 |

* cited by examiner

*Primary Examiner*—Anthony D Barfield
(74) *Attorney, Agent, or Firm*—Michael J. Striker

(57) ABSTRACT

A chair, in particular an office chair, has: a chair column, a seat holder secured to said chair column, and a backrest, wherein an adjusting mechanism is provided with which the backrest can be inclined relative to the vertical, wherein the adjusting mechanism includes an upward-arching curved guide, which is rigidly joined to the seat holder and on which a holder element that supports the backrest is movable along an upward-arching curved path for adjusting an inclination of the backrest, wherein the seat holder is inclined to a horizontal via an adjusting device secured to the chair column, and wherein the adjusting device includes a supporting arm, secured to the chair column, on which arm the seat holder is mounted pivotably via a joint with a horizontal pivot axis.

35 Claims, 5 Drawing Sheets

CHAIR

CROSS-REFERENCE TO A RELATED APPLICATION

This application is a continuation-in-part application of patent application Ser. No. 11/047,042 filed on Jan. 31, 2005 now abandoned.

BACKGROUND OF THE INVENTION

The invention relates to a chair, having a chair column, a seat holder secured to it, and a backrest, an adjusting mechanism being provided with which the backrest can be inclined relative to the vertical.

One such chair is known from German Patent Disclosure DE 196 07 136 A1, for example.

Especially in the field of office chairs, the adjustability of the backrest at least is the rule. For that purpose, more or less complex adjusting mechanisms are available on the market, which have in common the fact that they have many moving and nonmoving mechanical elements and components, which cooperate with one another in a more or less complicated way. Especially the moving parts are exposed to increased wear because of the operating forces involved.

Typically, the known constructions have a pivot point for the backrest adjuster that is located directly below the seat. The pivoting radius is approximately 20 to 30 cm. long. Thus, while pivotability of the backrest of the chair between the desired maximum angles of inclination is attained, but because of the short pivoting radius, the pivoting is effected in a relatively jerky motion, and the particular desired final position cannot be established particularly accurately, either.

The object of the present invention by comparison is for a chair that has the characteristics recited at the outset to be improved with the simplest possible means in such a way that the aforementioned disadvantages are largely overcome, and in particular that a gentler, more-accurate establishment of the angle of inclination of the backrest is made possible; the adjusting mechanism should also have fewer and simpler moving parts, and these parts are subjected to less wear.

SUMMARY OF THE INVENTION

According to the invention, this object is attained in both a surprisingly simple and an equally effective way in that the adjusting mechanism includes an upward-arching curved guide, which is rigidly joined to the seat holder and on which a holder element that supports the backrest is movable along an upward-arching curved path for adjusting the inclination of the backrest.

Because of the guidance of the holder element of the backrest on an arching curved path that is joined directly to the seat holder, the pivot point of the adjusting motion is no longer located directly below the seat; instead, the radius of the pivot axis can be selected to be substantially greater. The result is a considerably gentler adjustment of the angle of inclination of the backrest, since the backrest is pivoted more slowly than in the pivoting motions that involve the conventional very short pivoting radius. As a result of the provisions of the invention, a much more-accurate approach to the desired final position of the backrest is also possible. Because of the very simply construction of the adjusting mechanism, considerably fewer moving parts and joints are furthermore needed than in conventional pivoting mechanisms for office chairs, so that even over relatively long periods of time, much less wear of the moving parts is to be expected. This is also reinforced by the substantially gentler courses of motion.

According to the invention, the chair, in particular an office chair has a chair column; a seat holder secured to said chair column; and a backrest, wherein an adjusting mechanism is provided with which the backrest can be inclined relative to the vertical, wherein the adjusting mechanism includes an upward-arching curved guide, which is rigidly joined to the seat holder and on which a holder element that supports the backrest is movable along an upward-arching curved path for adjusting the inclination of the backrest, wherein the seat holder can be inclined to the horizontal via an adjusting device secured to the chair column, and wherein the adjusting device includes a supporting arm, secured to the chair column, on which arm the seat holder is mounted pivotably via a joint (8) with a horizontal pivot axis.

In a particularly preferred embodiment of the chair of the invention, the curved guide is arched such that the curved path for adjusting the inclination of the backrest has a pivoting radius>0.5 m, and preferably ≧1 m. The design of the adjusting mechanism makes it possible to locate the pivot point of the pivoting motion quite considerably below the level of the seat, making especially gentle courses of motion possible.

In a further embodiment that can be implemented especially simply and economically, the curved guide includes one or more upward-arching, preferably rodlike rails.

A refinement of this embodiment, in which one rail each is disposed laterally to the left and right on the seat holder, is especially preferred. As a result, great stability of the moving pivoting construction is attained even under heavy loads, such as users of a high body weight.

An embodiment of the chair of the invention in which the seat holder can be inclined relative to the horizontal via an adjusting device secured to the chair column is also preferred. In particular, a synchronous adjustment of the seat and backrest is possible in various embodiments, of the kind described for instance in German Patent Disclosure DE 44 03 123 A1 or German Utility Model DE 297 04 906 U.

A refinement of this embodiment that is very particularly preferred is characterized in that the synchronizing device for synchronous adjusting the inclination of the seat holder and backrest is provided; and that the synchronizing device includes a fluid-operated control device, which is joined on one side to the adjusting device for adjusting the inclination of the seat holder and on the other to the adjusting mechanism for adjusting the inclination of the backrest, and by means of which upon an adjustment of the inclination of the seat holder relative to the horizontal, a control signal is sent to the adjusting mechanism for adjusting the inclination of the backrest, which signal effects an adjustment of the angle of inclination of the backrest relative to the vertical to a predetermined or predeterminable angle value that is at a defined ratio to the angle of inclination of the seat holder relative to the horizontal.

Using a fluid control makes it possible to set the inclination motions arbitrarily continuously variably, and makes the courses of motion optimally gentle. The number of mechanical elements for the adjustment, such as joints, can be reduced to a minimum. In particular, complicated mechanical spring elements and gear or stepup devices that are at risk of wear are eliminated entirely.

In an especially preferred embodiment of the invention, the control device includes a pneumatic or hydraulic device with a pressure line system for pumping gas, in particular air, that is under pressure or liquid, in particular hydraulic oil, that is under pressure. Such pneumatic or hydraulic systems are well known in other fields of technology and has stood the test of time excellently.

It is especially advantageous if the adjusting device for adjusting the inclination of the seat holder has a pneumatic or hydraulic spring element, in particular a pneumatic or hydraulic cylinder, for actuating the seat holder adjuster. An especially gentle course of motion can thus be assured.

In an especially preferred refinement of the last two embodiments of the invention named above, the spring element sends a compression or suction pulse to the control device if the seat holder tilts. This triggers the adjustment of the inclination of the backrest.

Also preferred is an embodiment in which the adjusting mechanism for adjusting the inclination of the backrest has a pneumatic or hydraulic spring element, in particular a pneumatic or hydraulic cylinder, for actuating the backrest adjuster. In this way, the motion of the backrest as well can be designed to be especially gentle and flexible.

An embodiment of the invention that is very particularly preferred is one in which the control device includes control valves for controlling the motions of the adjusting device for adjusting the inclination of the seat holder and the adjusting mechanism for adjusting the inclination of the backrest. A valve control of this kind does not require any electronics and instead uses the fluid medium that is already present anyway. Moreover, with the control valves, the courses of motion can be executed or set especially gently and continuously variably in virtually arbitrary sequences.

In an especially advantageous refinement of this embodiment, the control valves are adjustable such that upon their actuation, a preferably continuously variably selectable limitation, damping or restoration of the motions of the adjusting device for adjusting the inclination of the seat holder and of the adjusting mechanism for adjusting the inclination of the backrest is effected.

In an advantageous variant, the control valves are adjustable such that upon their actuation, the inclination of the seat holder and/or of the backrest remains fixed in a defined, preferably selectable angular position. Thus in an extreme case, the seat holder can be firmly restrained while the backrest remains arbitrarily adjustable, or conversely, the backrest can be fixed while the seat holder can be adjusted. Arbitrary settings of the angles of inclination of the seat holder and backrest can be selected in between.

Furthermore, in variants of the invention, the control valves are adjustable or (for instance at the factory) preadjustable such that upon their actuation, the inclinations of the seat holder and the backrest can be adjusted at a defined angular ratio of the adjusting angles or at a fixed relative angle to one another. In this way, relatively simple, frequently recurring motion situations and courses can be programmed by especially simple means.

In a further advantageous embodiment, the adjusting device includes a supporting arm, secured to the chair column, on which arm the seat holder is mounted pivotably via a joint with a horizontal pivot axis. This type of adjusting device is especially simple to produce and is mechanically extremely stable and can withstand especially heavy loads.

A feature that is ergonomically especially favorable is one in which the joint with the horizontal pivot axis is disposed on the front end, facing away from the backrest, of the seat body, and in particular parallel to a front edge of the seat body. The advantages of this feature are described for instance in German Patent DE 196 07 136 C2 cited at the outset.

Further improvement in the ease of operation of such a chair according to the invention can be attained by providing that the joint with the horizontal pivot axis is disposed below a seat surface provided on the seat holder, or below a seat cushion.

Preferably, the seat holder can be secured rotatably about a vertical axis on the chair column, which in turn is practically the standard situation particularly with office chairs. The rotatability about the vertical axis can be accomplished most simply by providing that the supporting arm of the adjusting device is secured rotatably about a vertical axis on the chair column of the chair of the invention.

To make ergonomically favorable, simple operation of the adjusting mechanism of the invention possible, it is provided in an especially preferred embodiment that at least one actuating element for adjusting the inclination of the backrest relative to the vertical is disposed on the seat holder laterally on its left or right.

In an especially preferred refinement, one actuating element each for adjusting the inclination of the backrest relative to the vertical is disposed laterally to the left and right on the seat holder. As a result, the actuation can be done selectively with the left hand or the right hand or, depending on the design, with both hands.

Integrating the actuating elements with the armrests of the chair of the invention makes an ergonomically especially favorable design possible, in which no protruding parts or parts that are hard to find without visual contact have to be used. Instead, actuating elements located in this way can be found by the user more or less blindly. Moreover, this also makes for an aesthetically more-attractive design of the chair of the invention.

In an also-preferred embodiment, the backrest of the chair of the invention is constructed in shell form, which on the one hand opens up especially favorable design possibilities in terms of ergonomics, and on the other once again makes an aesthetically especially attractive design of the chair possible.

In especially simple embodiments of the chair of the invention, the backrest can be joined rigidly, in particular integrally, to the holder element. This is appropriate above all with the aforementioned shell-like embodiment of the backrest.

Alternatively, in other embodiments, a backrest that is tilted by a predeterminably settable, in particular lockable angle about a horizontal axis relative to the holder element can be provided; this makes more-individualized adaptation to particular user requirements possible than does the rigid variant mentioned first.

Further characteristics and advantages of the invention will become apparent from the ensuing detailed description of exemplary embodiments of the invention in conjunction with the drawings, which show details essential to the invention, and from the claims. The individual characteristics can each be implemented individually on their own or put together in arbitrary combinations in variants of the invention.

In the schematic drawings, exemplary embodiments of the invention are shown which are explained in further detail in the ensuing description.

DESCRIPTION OF THE PREFERRED EMBODIMENTS

Figure 1B:
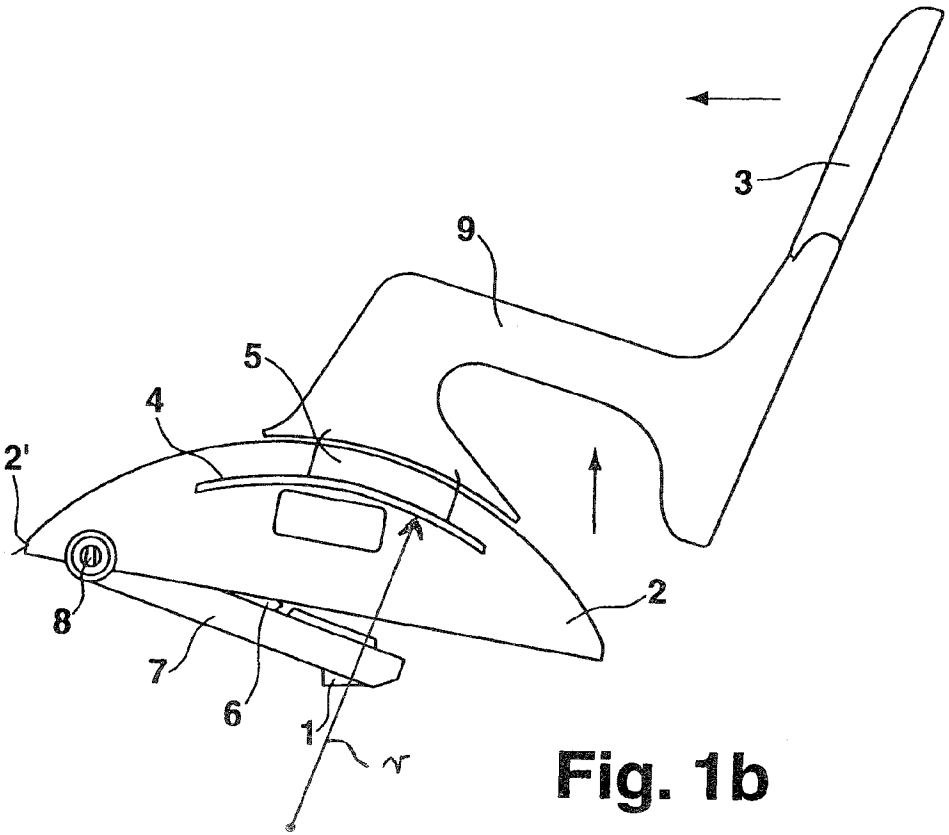
FIG. 1*b*, the embodiment of FIG. 1*a*, with the seat surface tilted toward the back and the backrest correspondingly tilted toward the back.
Figure 1A:
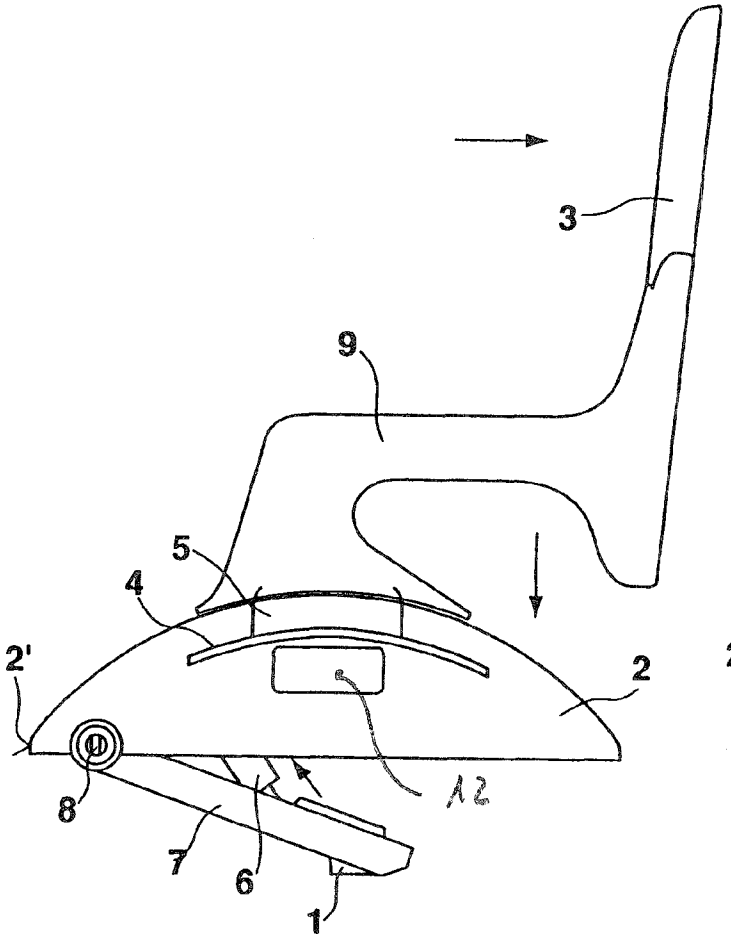
FIG. 1*a*, a schematic, partly transparent side view of the upper part of one embodiment of the chair of the invention, in a horizontal position of the seat surface and with the backrest set vertically steeply.

The upper half of the chair shown in FIGS. 1*a* and 1*b* includes a chair column 1, with a seat holder 2 secured to it via a supporting arm 7 and a joint 8 with a horizontal pivot axis. By means of an adjusting device, which among other possibilities includes a pneumatic or hydraulic spring element 6, the inclination of the seat holder 2 relative to the horizontal can be adjusted. Preferably, the supporting arm 7 is also secured, rotatably about a vertical axis, to the chair column 1, so that the seat holder 2 can likewise be rotated about this vertical axis. The joint 8, which is pivotable about a horizontal axis, is ergonomically favorably disposed below a seat surface, provided on the seat holder 2 but not shown in the drawing, or below a seat cushion, parallel to the front edge 2' of the front end, facing away from the backrest 3, of the seat holder 2.

Figure 3A:
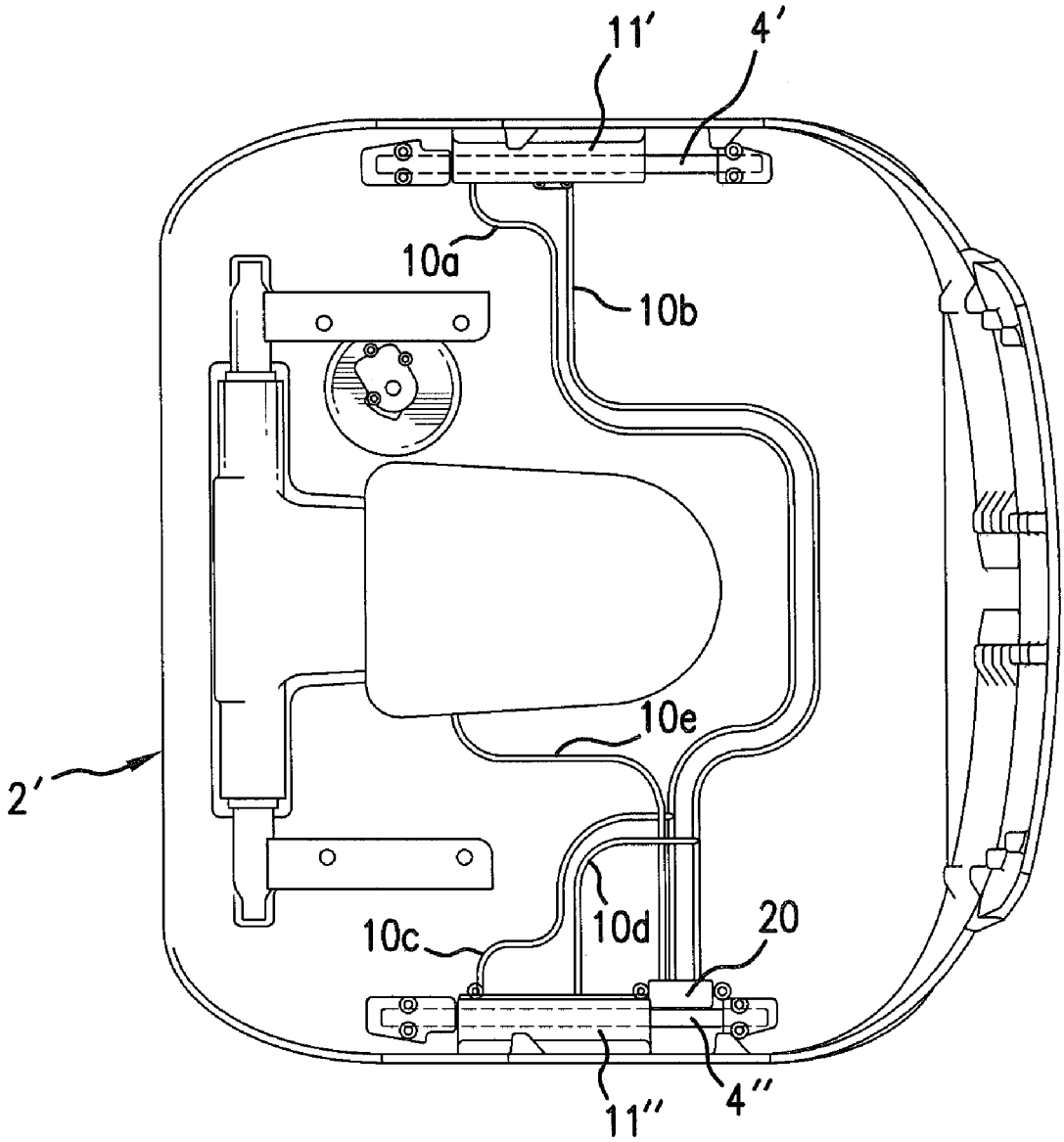
FIG. 3*a*, a schematic, partly transparent plan view from above onto the embodiment of FIG. 2*a*, schematically showing a fluid control of the chair adjustment.
Figure 3C:
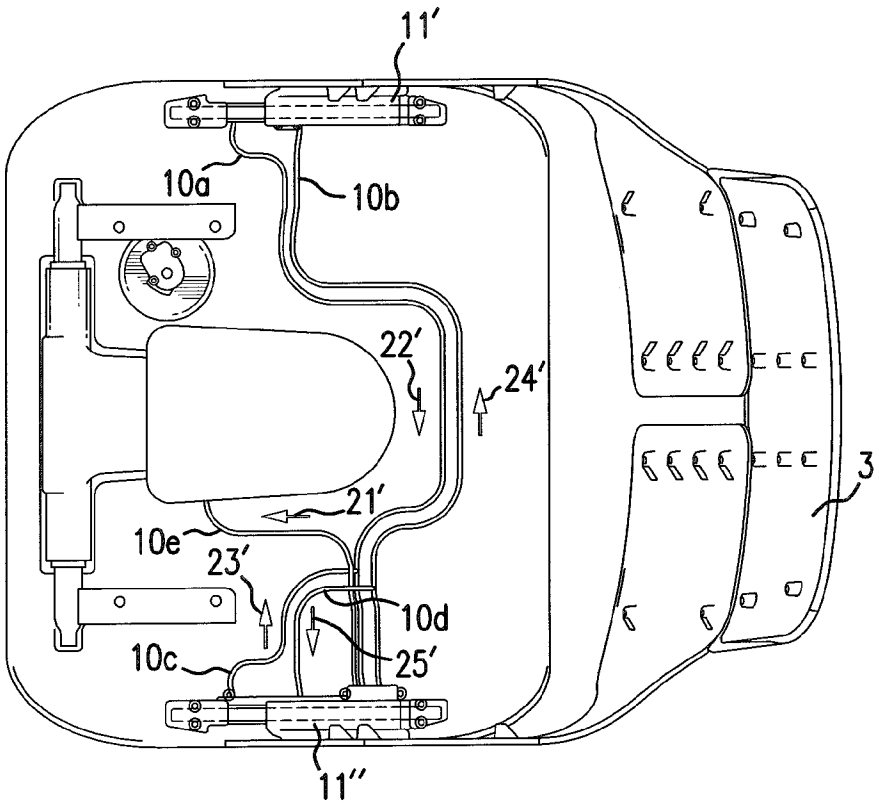
FIG. 3*c*, a plan view of the situation of FIG. 2*c*.
Figure 3B:
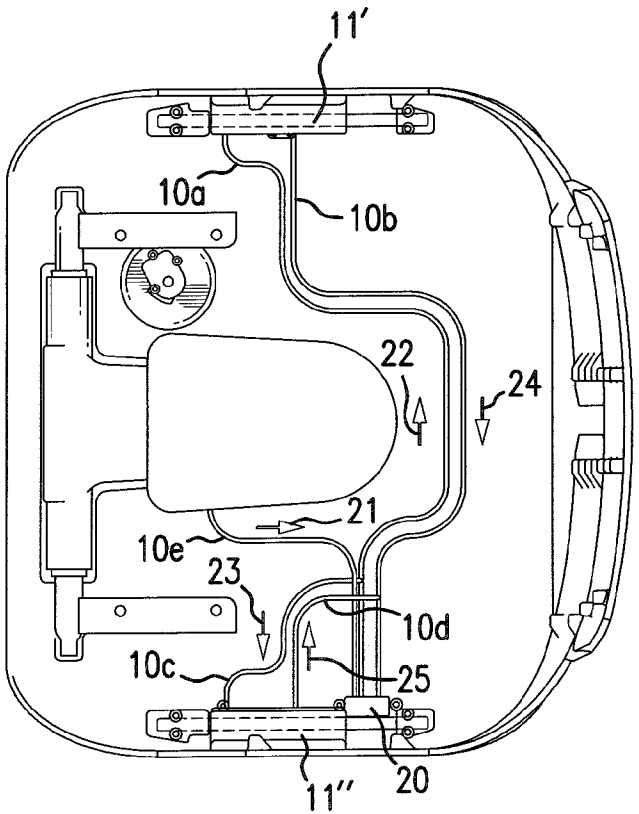
FIG. 3*b*, a plan view of the situation of FIG. 2*b;*

Also shown in FIGS. 1*a* and 1*b* is an adjusting mechanism for adjusting the inclination of the backrest 3 relative to the vertical; it includes an upward-arching curved guide 4, which is rigidly joined to the seat holder 2, and on which a holder element 5 that supports the backrest 3 can be moved along an upward-arching curved path for adjusting the inclination of the backrest 3. As shown in FIGS. 3*a* through 3*c* and in FIG. 4, the curved guide 4 includes two upward-arching rodlike rails 4', 4", located on the seat holder 2 on its left and right.

Figure 4:
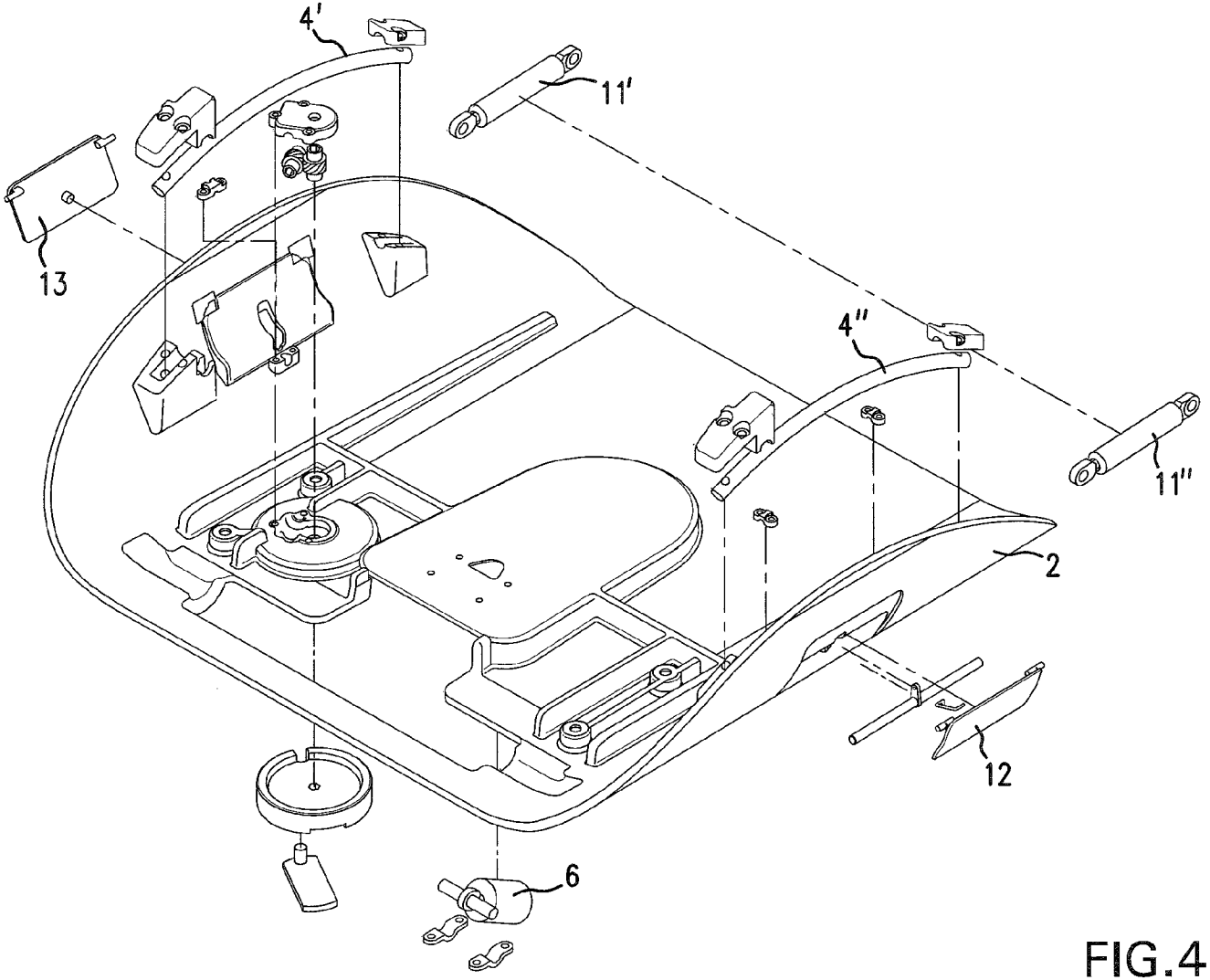
FIG. 4 an exploded view of the seat with guiding and fastening means.

An actuating element 12 for adjusting the inclination of the backrest 3 relative to the vertical is shown in FIG. 4. A further actuating element 13 can be seen from FIG. 4. The actuating elements 12, 13 are preferably integrated, laterally to the left and right on the seat holder 2, with armrests 9 of the chair.

The backrest 3 may also be constructed in shell form and joined either rigidly, in particular integrally, to the holder element 5 or can be tiltable about a horizontal axis relative to the holder element 5 by a predeterminably settable, lockable angle.

Figure 2C:
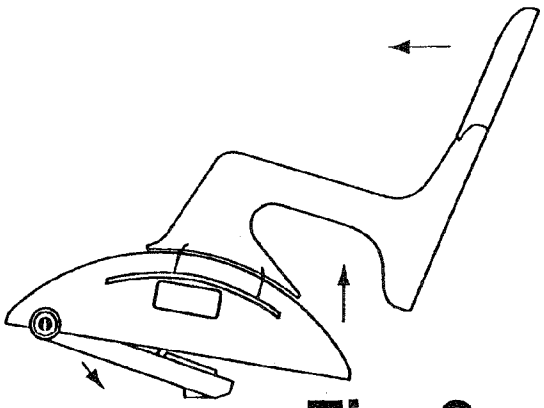
FIG. 2*c*, the embodiment of FIG. 1, before a restoration of the seat surface and the backrest from a position inclined toward the rear back to an upright normal position.
Figure 2B:
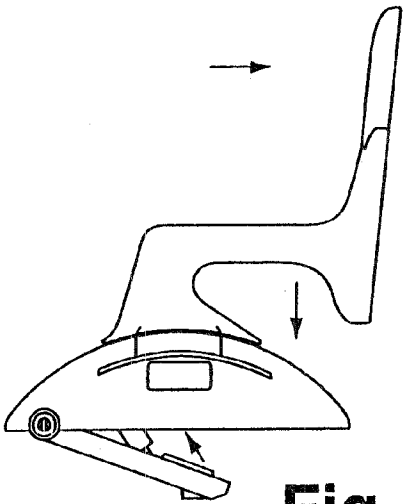
FIG. 2*b*, the embodiment of FIG. 1*a*, before an adjustment of the seat surface and the backrest to an obliquely upward-inclined position of the seat surface or a position of the backrest inclined toward the rear.
Figure 2A:
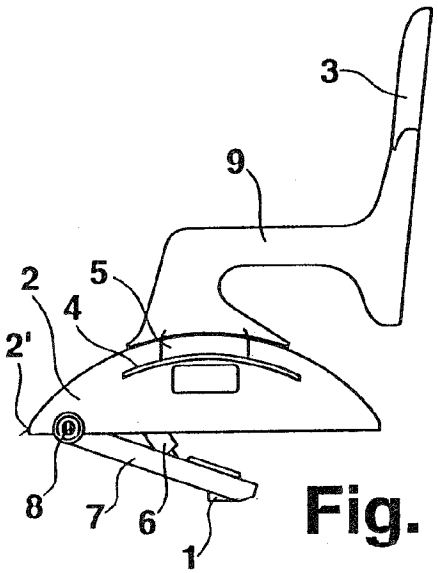
FIG. 2*a*, the embodiment of FIG. 1*a*, in a normal position.

In FIGS. 2*a* through 2*c*, various adjustment situations of a chair embodied according to the invention are shown. FIG. 2*a* shows the chair in a normal position; FIG. 2*b* (corresponding to FIG. 1*a*) shows the chair before an adjustment of the seat holder 2 and backrest 3 out of the normal position into an obliquely upward-inclined position of the seat surface and into a rearward-inclined position of the backrest 3, and the straight arrows are meant to indicate the particular direction of motion of the parts of the chair to be moved.

In FIG. 2*c* (corresponding to FIG. 1*b*), the chair is seen before a restoration of the seat holder 2 and backrest 3 out of a rearward-inclined position back to an upright normal position shown in FIG. 2*a*.

FIGS. 3*a* through 3*c* each shows schematic, partly transparent plan views from above on the situations shown in FIG. 2*a*-2*c*. In particular, FIGS. 3*a* through 3*c* show a fluid control for synchronous adjusting the inclination of the seat holder 2 and backrest 3.

The synchronizing device includes a control device, operated with a fluid, which is joined on the one hand to the adjusting device for adjusting the inclination of the seat holder 2 and on the other to the adjusting mechanism for adjusting the inclination of the backrest 3. By means of this control device, which includes a pneumatic or hydraulic device with a pressure line system 10*a-e* for feeding gas, in particular air, that is under pressure or liquid, in particular hydraulic oil, that is under pressure, upon an adjustment of the inclination of the seat holder 2 relative to the horizontal, synchronously with it an adjustment of the angle of inclination of the backrest 3 relative to the vertical is made, to a predetermined or predeterminable value or a desired ratio of the two angles of inclination, by sending a control signal to the adjusting mechanism for adjusting the backrest.

Beginning in the normal position shown in FIGS. 2*a* and 3*a*, a pressure pulse is output into the pressure line 10*e* of the control device in the direction of arrow 21 upon tilting of the seat holder 2 to the rear via the spring element 6, as a result of the compression of the spring element (s. FIG. 3*b*); this signal, via a control valve 20, actuates the synchronous motion for the adjusting the inclination of the backrest 3. The adjusting mechanism for the backrest 3 has pneumatic or hydraulic double acting spring elements 11, 11' for this purpose, which in the exemplary embodiment shown are disposed on both sides of the chair on the rails 4, 4' of the curved guide 4. The flow direction of the fluid stream that is put into motion by the pressure pulse in the pressure line system 10*a*-10*e* is represented in FIG. 3*b* by arrows 21 to 25.

When the actuating element 12 (FIG. 4) is pressed and a person using the chair leans its back against the backrest 3, the pressure pulse from spring element 6 through the line 10*e* is guided to valve 20 which is open when pressing actuating element 12. The fluid of pressure line 10*e* is transmitted to lines 10*a* and 10*c* (arrows 22, 23) which are connected to the front portions of the double acting spring elements 11', 11" respectively. This causes a motion of the housing of spring elements 11', 11" backwards as can be seen from FIG. 3*c*. With the housings of elements 11' and 11" also holder elements 5, armrests 9 and backrest 3 of the chair move backwards.

While moving backwards, the spring elements 11', 11" press fluid into pressure lines 10*b*, 10*d* connected to their rear ends respectively. This is indicated by arrows 24 and 25. The fluid coming from the rear ends of spring elements 11', 11" is also directed to the front ends of these elements by control valve 20. When actuating element 12 is released valve 20 is closed and the seat holder 2 and back rest 3 are fixed in the inclined position.

In FIGS. 2*c* and 3*c*, the reciprocal motion situation to FIGS. 2*b* and 3*b* is shown; in it, the seat holder 2 is to be returned to its vertical normal position and the backrest 3 to its upright normal position shown in FIG. 2*a*. The flow arrows shown in FIG. 3*c* now point in the opposite direction to the fluid flows shown in FIG. 3*b*.

When actuating element 12 is pressed again and the user leans forward, the backrest moves forward and causes the double acting spring elements 11' and 11" also to move forward. By this movement fluid is pressed into lines 10*a*, 10*c* which is distributed by valve 20 to lines 10*b*, 10*d* to the rear end of the spring elements 11', 11" and also to line 10*e* which is connected to spring element 6. This causes an expansion of spring element 6 and therefore an uplifting of the rear edge to the seat holder 2.

It will be understood that each of the elements described above, or two or more together, may also find a useful application in other types of constructions differing from the type described above.

While the invention has been illustrated and described as embodied in a chair, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A chair, comprising: a chair column (1); a seat holder (2) secured to said chair column; and a backrest (3), wherein an adjusting mechanism is provided with which the backrest (3) can be inclined relative to the vertical, wherein the adjusting mechanism includes an upward-arching curved guide (4), which is rigidly joined to the seat holder (2) and on which a holder element (5) that supports the backrest (3) is movable along an upward-arching curved path for adjusting an inclination of the backrest (3), wherein the seat holder (2) is inclinable to a horizontal via an adjusting device secured to the chair column (1), and wherein the adjusting device includes a supporting arm (7), secured to the chair column (1), on which arm the seat holder (2) is mounted pivotably via a joint (8) with a horizontal pivot axis.

2. The chair of claim 1, wherein the curved guide (4) is arched such that a curved path for adjusting the inclination of the backrest (3) has a pivoting radius (r)>0.5 m.

3. The chair of claim 1, wherein the curved guide (4) includes at least one upward-arching rail (4' and 4").

4. The chair of claim 2, wherein the curved guide (4) is arched such that the curved path for adjusting the inclination of the backrest (3) has the pivoting radius preferably more ≧1 m.

5. The chair of claim 3, wherein the upward-arching rail is rod-shaped.

6. The chair of claim 3, wherein the curved guide (4) includes more than one upward-arching rails.

7. The chair of claim 3, wherein one rail (4', 4") is disposed laterally to the left and right on the seat holder (2).

8. The chair of claim 1, wherein a synchronizing device for synchronous adjusting the inclination of the seat holder (2) and backrest (3) is provided; and the synchronizing device includes a fluid-operated control device (10-10*e*, 20), which is joined on one side to the adjusting device for adjusting the inclination of the seat holder (2) and on the other to the adjusting mechanism for adjusting the inclination of the backrest (3), and by which upon an adjustment of the inclination of the seat holder (2) relative to the horizontal, a control signal is sent to the adjusting mechanism for adjusting the inclination of the backrest (3), which signal effects an adjustment of the angle of inclination of the backrest (3) relative to the vertical to a predetermined or predeterminable angle value that is at a defined ratio to the angle of inclination of the seat holder (3) relative to the horizontal.

9. The chair of claim 8, wherein the control device includes a device selected from the group consisting of a pneumatic device and a hydraulic device with a pressure line system (10) for pumping a medium selected from the group consisting of gas, that is under pressure and liquid that is under pressure.

10. The chair of claim 9, wherein the pressure line system (10) pumps a medium selected from the group consisting of air and hydraulic oil.

11. The chair of claim 8, wherein the adjusting device for adjusting the inclination of the seat holder (2) has a sprinq element selected from the group consisting of a pneumatic spring element and a hydraulic spring element (6), for actuating adjustment of the seat holder.

12. The chair of claim 11, wherein the spring element (6) is configured so that it sends a pulse selected from the group consisting of a compression pulse and a suction pulse to a control device (10*a*-10*e*, 20) if the seat holder (2) tilts.

13. The chair of claim 11, wherein the spring element is a cylinder selected from the group consisting of a pneumatic cylinder and a hydraulic cylinder.

14. The chair of claim 1, wherein the adjusting mechanism for adjusting the inclination of the backrest (3) has at least one spring element selected from the group consisting of a pneumatic sprinq element and a hydraulic spring element (11', 11"), for actuating adjustment of the backrest.

15. The chair of claim 14, wherein the spring element is a double acting cylinder selected from the group consisting of a pneumatic double acting cylinder and a hydraulic double acting cylinder.

16. The chair of claim 1, wherein a control device is provided and includes a control valve (20) for controlling the motions of the adjusting device for adjusting the inclination of the seat holder (2) and the adjusting mechanism for adjusting the inclination of the backrest (3).

17. The chair of claim 16, wherein the control valve (20) is adjustable such that upon its actuation, an action selected from the group consisting of a limitation, a damping and a restoration of motions of the adjusting device for adjusting the inclination of the seat holder (2) and of the adjusting mechanism for adjusting the inclination of the backrest (3) is effected.

18. The chair of claim 17, wherein the control valve (20) is adjustable such that upon its actuation of an action selected from the group consisting of a continuously variably selectable limitation, a continuously variably selectable damping, and a continuously variably selectable restoration of motions of the adjusting device and of the adjusting mechanism is effected.

19. The chair of claim 17, wherein the control valve (20) is adjustable such that upon its actuation, the inclination of a part selected from the group consisting of the seat holder (2), the backrest (3) and both remains fixed in a defined angular position.

20. The chair of claim 19, wherein the control valve (20) is adjustable such that upon its actuation the inclination of the part remains fixed in the defined angular position which is selectable.

21. The chair of claim 17, wherein the control valve (20) is adjustable or preadjustable such that upon its actuation, the inclinations of the seat holder (2) and the backrest (3) is adjustable in a manner selected from the group consisting of at a defined angular ratio of adjusting angles and at a fixed relative angle to one another.

22. The chair of claim 1, wherein the joint (8) with the horizontal pivot axis is disposed on a front end, facing away from the backrest (3), of the seat holder (2).

23. The chair of claim 22, wherein the joint (8) is disposed on the front end of the seat holder parallel to a front edge of the seat holder.

24. The chair of claim 1, wherein the joint (8) with the horizontal pivot axis is disposed below a seat surface provided at a location selected from the group consisting of on the seat holder (2), and below a seat cushion.

25. The chair of claim 1, wherein the seat holder (2) is secured rotatably about a vertical axis on the chair column (1).

26. The chair of claim 25, wherein a supporting arm (7) is secured rotatably about a vertical axis on the chair column (1).

27. The chair of claim 1, wherein at least one actuating element for adjusting the inclination of the backrest (3) relative to the vertical is disposed on the seat holder (2) laterally on a side selected from the group consisting of on its left and on its right.

28. The chair of claim 27, wherein at least one actuating element each for adjusting the inclination of the backrest (3) relative to the vertical is disposed laterally to the left and right on the seat holder (2).

29. The chair of claim 28, wherein the actuating element is integrated in an armest (9) of the chair.

30. The chair of claim 29, wherein the actuation elements are integrated in the armrests (9) of the chair.

31. The chair of claim 1, wherein the backrest (3) is constructed in shell form.

32. The chair of claim 1, wherein the backrest (3) is tiltable by an angle about a horizontal axis relative to a holder element (5).

33. The chair of claim 32, wherein the backrest (3) is liftable by the angle which is predeterminably adjustable and lockable.

34. The chair of claim 1, wherein the backrest (3) is joined rigidly to a holder element (5).

35. The chair as defined in claim 34, wherein the backrest (3) is joined integrally to the holder element (5).

* * * * *